US006231362B1

(12) United States Patent
Wu

(10) Patent No.: US 6,231,362 B1
(45) Date of Patent: May 15, 2001

(54) ELECTRICAL CONNECTOR WITH AN IMPROVED SWITCH STRUCTURE

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,661

(22) Filed: Dec. 29, 1999

(30) Foreign Application Priority Data

Dec. 14, 1999 (TW) ..... 88221282

(51) Int. Cl.[7] ..... H01R 29/00
(52) U.S. Cl. ..... 439/188
(58) Field of Search ..... 439/188, 676

(56) References Cited

U.S. PATENT DOCUMENTS 5,030,123 * 7/1991 Silver ..... 439/188
5,704,797 * 1/1998 Meyerhoefer et al. ..... 439/188
6,012,936 * 1/2000 Siemon et al. ..... 439/188

* cited by examiner

*Primary Examiner*—Gary F. Paumen

(74) *Attorney, Agent, or Firm*—Wei Te Chung

(57) ABSTRACT

An electrical connector comprises an insulative housing, a number of terminals, a pair of switch members, and a door assembled into the housing. The housing comprises opposing top and bottom walls, two side walls, and front and rear walls. A mating opening is defined through the front wall and a receiving cavity is defined in the housing and in communication with the mating opening. Each terminal has a free contact portion extending into the receiving cavity and moveable by a mating connector. Each switch member comprises a securing portion secured to the rear wall of the insulative housing and a depending portion extending from the securing portion for electrically connecting with a corresponding terminal. The door is pivotally mounted in the top wall of the housing, and comprises a main body abutting against the depending portion of the switch member. In a first position, when no mating connector is inserted into the receiving cavity, the depending portion of each switch member is biased outwardly by a pushing force from a corresponding terminal. In a second position, when an inserted mating connector has been inserted, the terminals are pushed downward away from the switch members, and the door is pushed rearward, exerting an opposite biasing force inward against the switch members. Thus the switch members are subject to two opposite biasing forces, helping them maintain resiliency over a longer period.

1 Claim, 7 Drawing Sheets

ELECTRICAL CONNECTOR WITH AN IMPROVED SWITCH STRUCTURE

BACKGROUND OF THE INVENTION

The present invention relates to a modular jack electrical connector, and particularly to a connector having an improved switch structure for connecting the terminals of the connector to a circuit in a printed circuit board when the terminals are not mated to a mating connector.

U.S. Pat. No. 5,030,123 discloses a modular jack connector referring to FIG. 7. The conventional connector 200 comprises an insulative housing 60 and a plurality of terminals 80 received in the housing 60. One end of each terminal 80 is a resilient contact portion 82 and the other end is a solder portion 84 extending out of the housing 60 for soldering to the printed circuit board (not shown). The conventional connector 200 furthermore comprises a plurality of switch members 90 received in the housing 60. One end of each switch member 90 is a free contacting portion 92 slantingly extending for contacting the contact portion 82 of the terminal 80. The other end of the switch member 90 also extends out of the housing 60 for soldering to the printed circuit board, whereby a circuit on the printed circuit board can be closed via contact between the switch member 90 and the terminal 80. The contacting portion 92 of the switch member 90 engages with the contact portion 82 except when a mating connector (not shown) is mated with the conventional connector 200, which presses the contact portion 82 down and breaks the connection between the contact portion 82 and the contacting portion 92. The contacting portion 92 is subject to resilient fatigue and easily loses its resiliency when the contact portion 82 is engaged therewith. Additionally, a patina forms on the surface of the switch member whereby the contact resistance of the switch member increases after long use. Hence, an improved electrical connector is required to overcome the disadvantages of the prior art.

BRIEF SUMMARY OF THE INVENTION

A main object of the present invention is to provide a door covering the switch member whereby the switch member is biased in two opposite directions when a mating connector mates and when a mating connector is not mated with the modular jack.

A modular jack electrical connector comprises an insulative housing, a plurality of terminals received in the housing, a pair of switch members also received in the housing, and a door assembled in the housing and abutting against the switch member.

The housing comprises opposing top and bottom walls, two side walls, and front and rear walls. A mating opening is defined through the front wall and a receiving cavity is defined in the housing and in communication with the mating opening. Each terminal has a free contact portion extending into the receiving cavity and moveable by a mating connector. Each switch member comprises a securing portion secured to the rear wall of the insulative housing and a depending portion extending from the securing portion for electrically connecting with a corresponding terminal. The door is pivotally mounted in the top wall of the housing, and comprises a main body abutting against the depending portion of the switch member. In a first position, when no mating connector is inserted into the receiving cavity, the depending portion of each switch member is biased outwardly by a pushing force from a corresponding terminal. In a second position, when an inserted mating connector has been inserted, the terminals are pushed downward away from the switch members, and the door is pushed rearward, exerting an opposite biasing forces inward against the switch members. Thus the switch members are subject to two opposite biasing forces, helping them maintain resiliency over a longer period.

Other objects, advantages and novel features of the invention will become more apparent from the following detailed description of the present embodiment when taken in conjunction with the accompanying drawings.

DETAILED DESCRIPTION OF THE INVENTION

Figure 1:
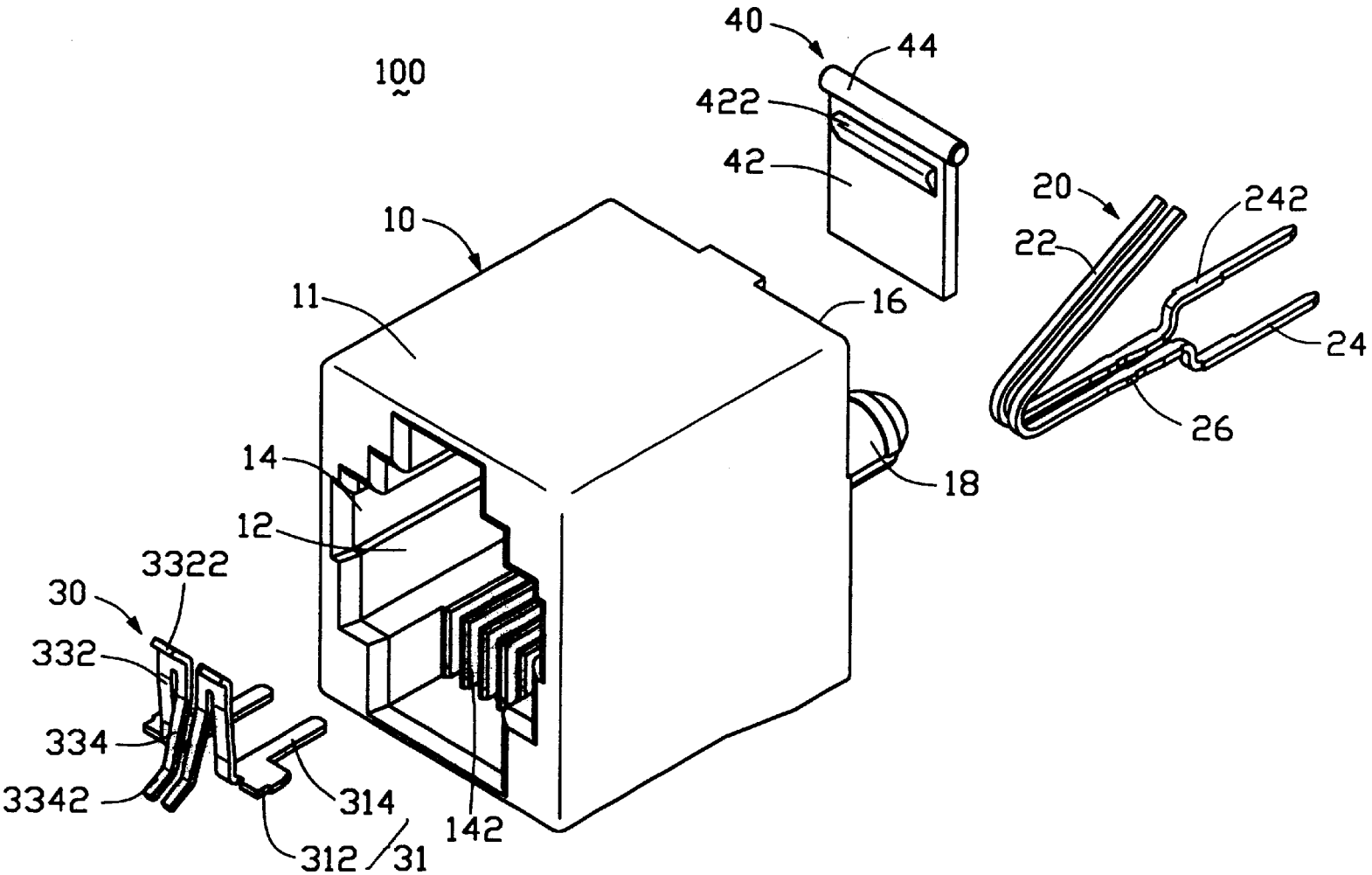
FIG. 1 is an exploded view of an electrical connector in accordance with the present invention.

Referring to FIG. 1, an electrical connector 100 comprises an insulative housing 10, a plurality of terminals 20 received in the housing 10, a pair of switch members 30 also received in the housing 10, and a door 40 assembled in the housing 10 and abutting against the switch member 30.

Figures 4A, 4B, 4C:
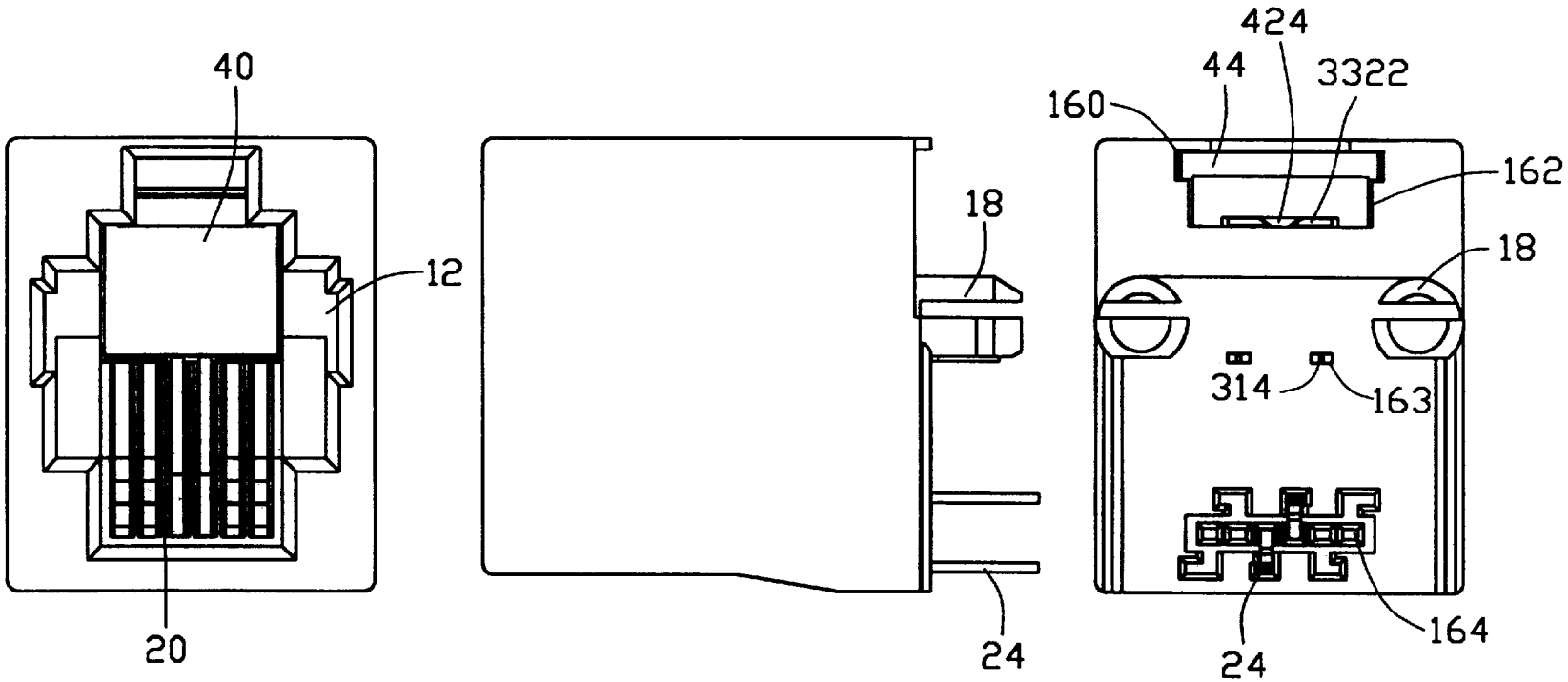
FIG. 4A is a front view of FIG. 3.
FIG. 4B is a side view of FIG. 3.
FIG. 4C is a rear view of FIG. 3.

The insulative housing 10 is roughly a cube comprising a top wall 11, an opposite bottom wall (not labelled), a pair of opposing side walls (not labelled), a front wall (not labelled) defining a mating opening 12 therein, a rear wall 16 opposite the front wall, and a receiving cavity 14 defined in the insulative housing 10 and in communication with the mating opening 12. A bump 110 is formed on an inside surface (not labelled) of the top wall 11 and extending into the receiving cavity 14. A plurality of baffles 142 extends from the inside surface of the bottom wall of housing 10 into the receiving cavity 14. Referring to FIG. 4C, a slot 160 is defined through the rear wall 16 near the top wall 11 and a mounting opening 162 is defined beneath the slot 160 of the rear wall 16 and in communication with the slot 160. The mounting opening 162 is slightly narrower than the slot 160. A pair of mounting posts 18 is formed at both sides of a middle of the rear wall 16 extending perpendicularly to the rear wall 16 for mounting to a printed circuit board (not shown). Two through holes 163 are defined between the two mounting posts 18 in the rear wall 16. A row of aligned receiving holes 164 is defined through a lower portion (not labelled) of the rear wall 16, and equal numbers of positioning holes 165 alternately extend from the receiving holes 164 to either side of the row of receiving holes 164.

Each terminal 20 is bent to an acute angle, and comprises a free contact portion 22 at a front end and a solder portion 24 at an opposite rear end. A shoulder 242 is formed at either side of the solder portion 24. A retaining portion 26 is formed between the contact portion 22 and the solder portion 24 and adjacent to the forward shoulder 242 of the solder portion 24.

Each switch member 30 is roughly in the shape of the letter L, and comprises a securing portion 31 and a depending portion 33. The securing portion 31 comprises an interfering portion 312 for securing to the rear wall 16 of the housing 10, a solder leg 314 for soldering to the printed circuit board. The depending portion 33 comprises a support portion 332 extending upward from the securing portion 31 and a resilient arm 334 extending downward and forward at an angle from a top end of the support portion 332. A positioning portion 3322 slantways extends upward and forward from the top end of the support portion 332. A free contacting portion 3342 is formed at the end of the resilient arm 334.

Figure 2:
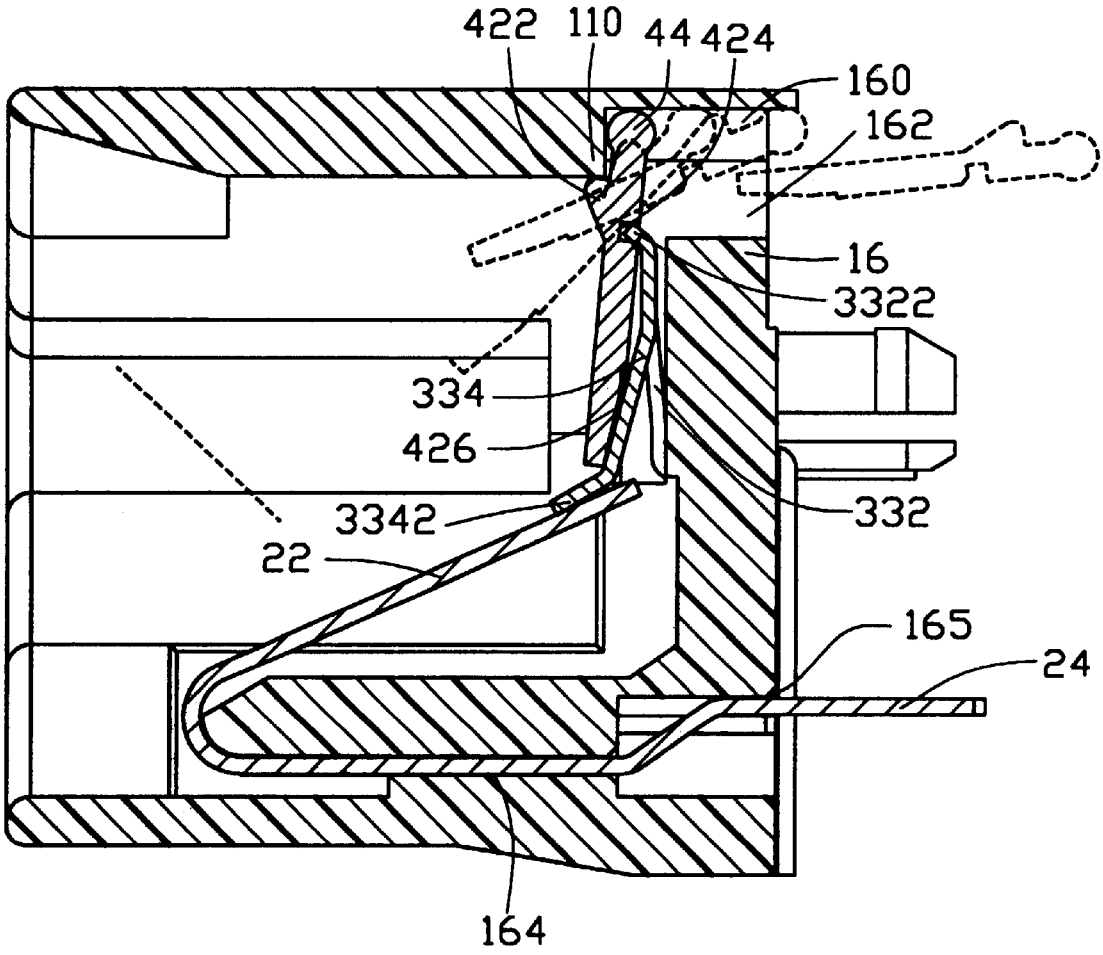
FIG. 2 is a cross-sectional view of the electrical connector of FIG. 1 showing the sequence of assembling the door into the electrical connector.

Referring to FIG. 2, the door 40 comprises a main body 42 and a pivot portion 44 formed on an upper end of the main body 42. A protrusion 422 projects from a front side of the main body 42, and a groove 424 is defined in a rear side of the main body 42. A pair of beveled slots 426 is defined in the lower rear side of the main body 42 complementary to the contours of the resilient arm 334 of the switch member 30.

Figure 3:
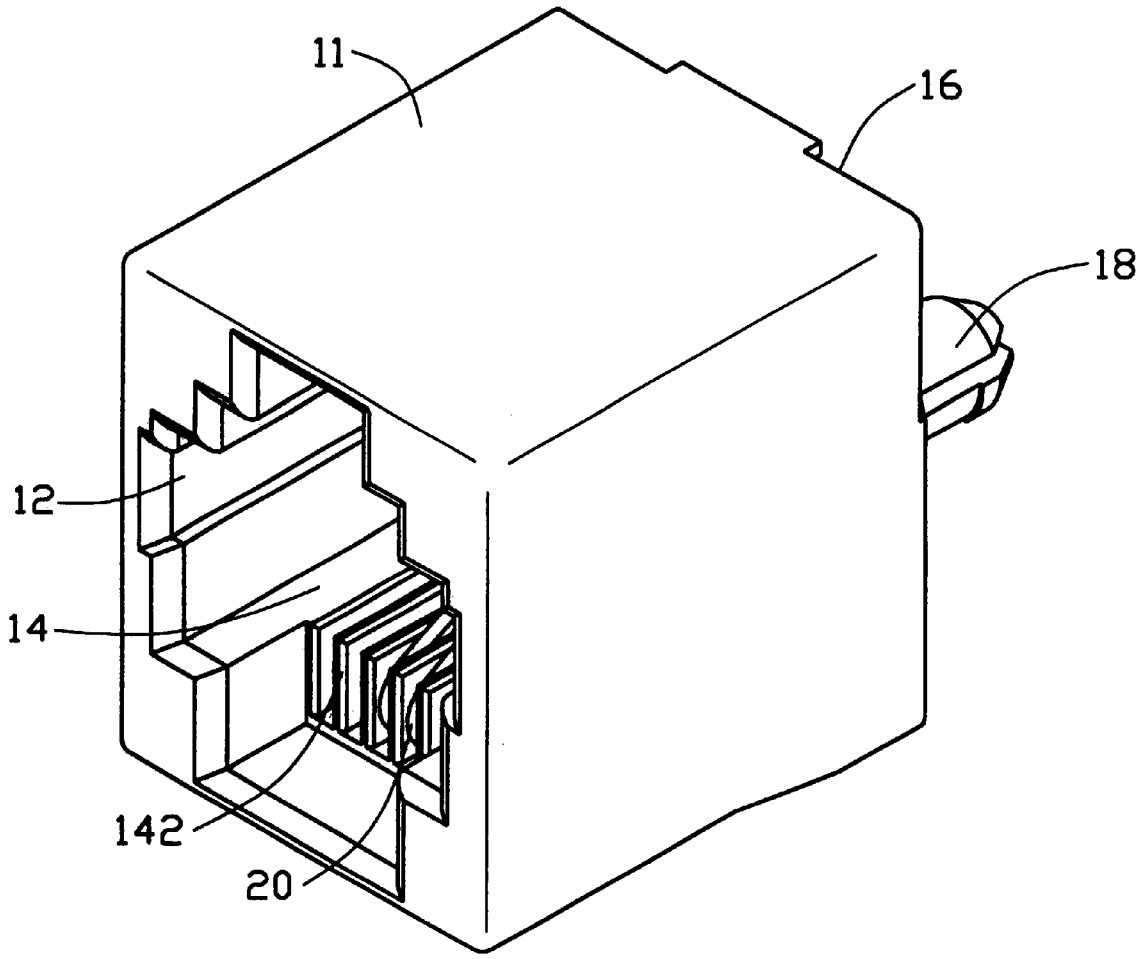
FIG. 3 is an assembled view of FIG. 1.

Referring to FIG. 2; FIG. 3; FIG. 4A; FIG. 4B and FIG. 4C, in assembly, each of terminals 20 is assembled into the receiving cavity 14 of the housing 10 between adjacent baffles 142. Each solder portion 24 extends through the corresponding positioning hole 165 for soldering to the printed circuit board. Each retaining portion 26 is retained in the corresponding receiving hole 164 of the rear wall 16 of the housing 10. The shoulder 242 of each terminal 20 interferentially fits with the positioning hole 165 of the rear wall 16, and the contact portion 22 extends out from between a pair of baffles 142.

Each switch member 30 is assembled through the mating opening 12 into the rear wall 16 of the housing 10. Each solder leg 314 extends through a corresponding through hole 163 for soldering to the printed circuit board, each interfering portion 312 abuts a rear side of the through hole 163, and each support portion 332 abuts against the inner face (not labelled) of the rear wall 16.

Referring to FIG. 2, the door 40 is assembled into the housing 10 by the main body 42 being inserted through the mounting opening 162. Then the pivot portion 44 inserts into the slot 160 for pivotally mounting in the top wall 11 of housing 10. The positioning portions 3322 of the switch members 30 engage with the grooves 424 of the door 40. The resilient arms 334 correspondingly enter into the beveled slots 426 of the main body 42 of the door 40.

Figure 5:
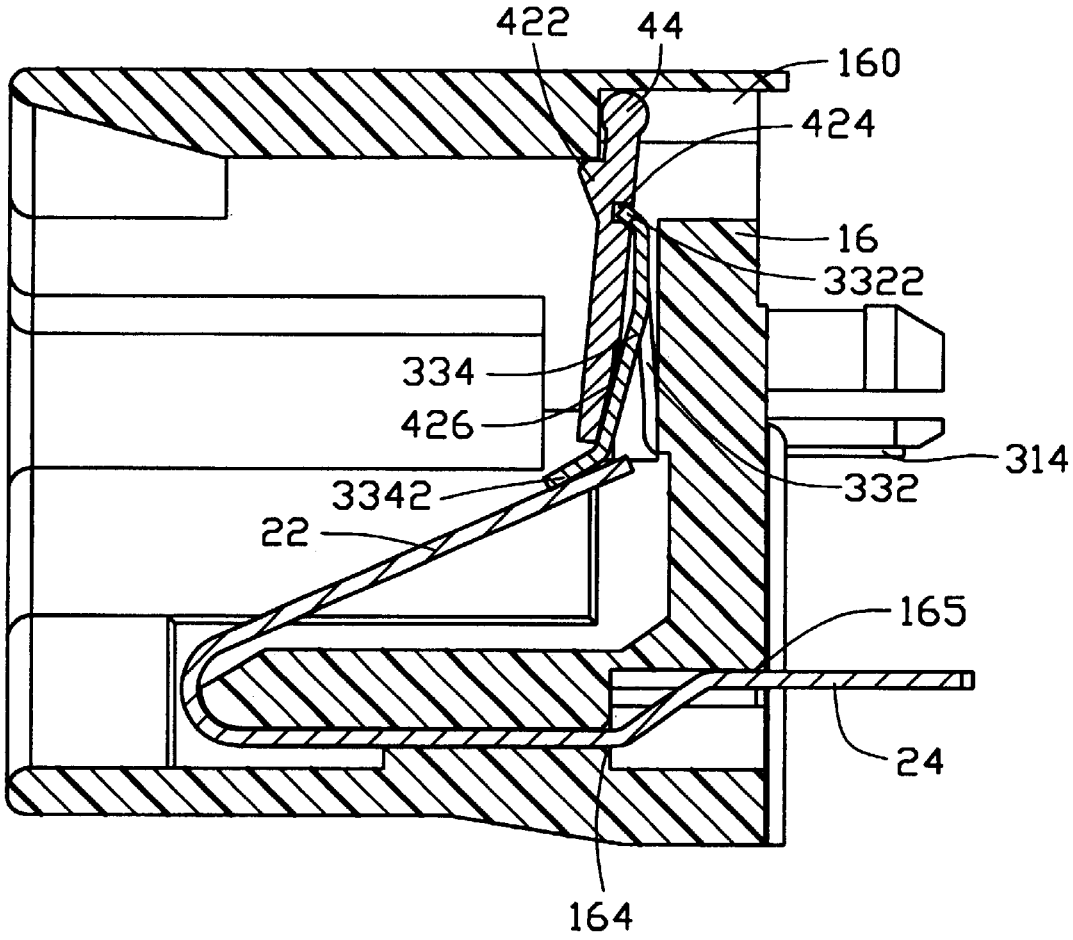
FIG. 5 is a cross-sectional view of the electrical connector of the present invention connector when a mating connector is not present.
Figure 6:
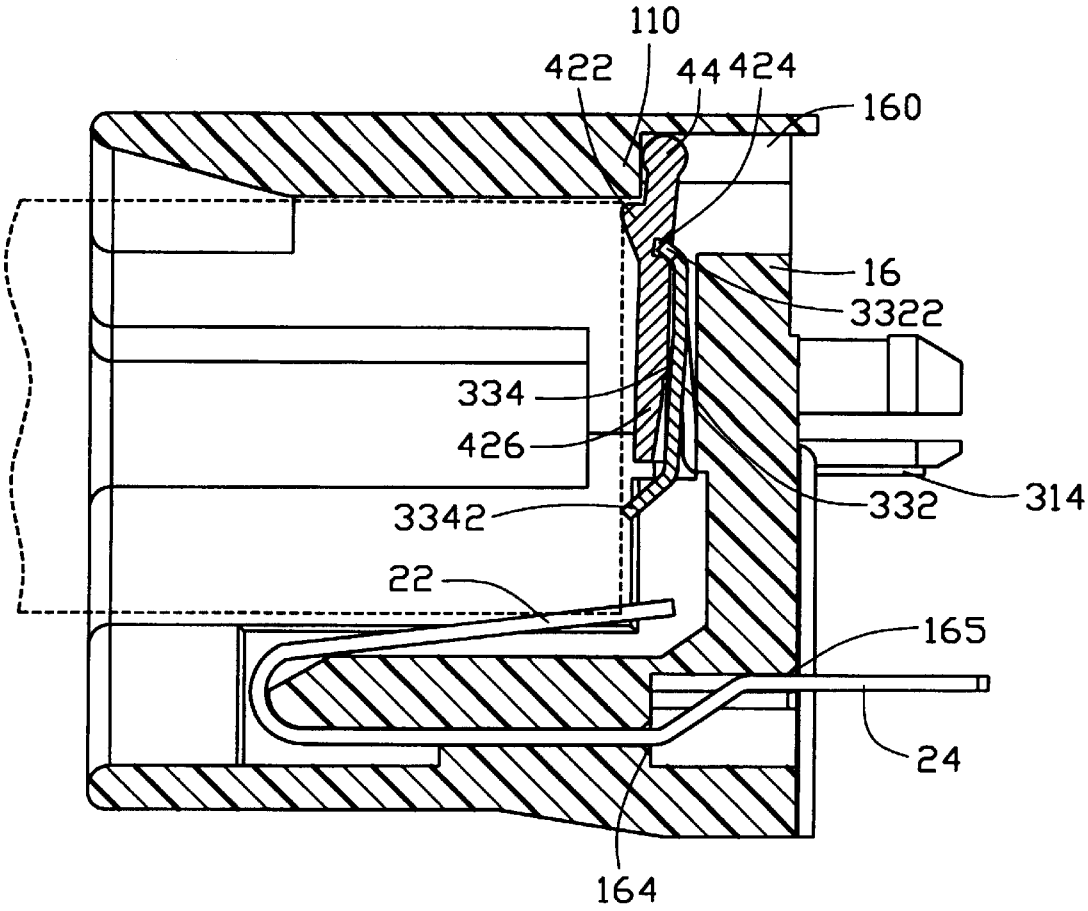
FIG. 6 is a cross-sectional view of the electrical connector of FIG. 5 when a mating connector is mated with the electrical connector.
Figure 7:
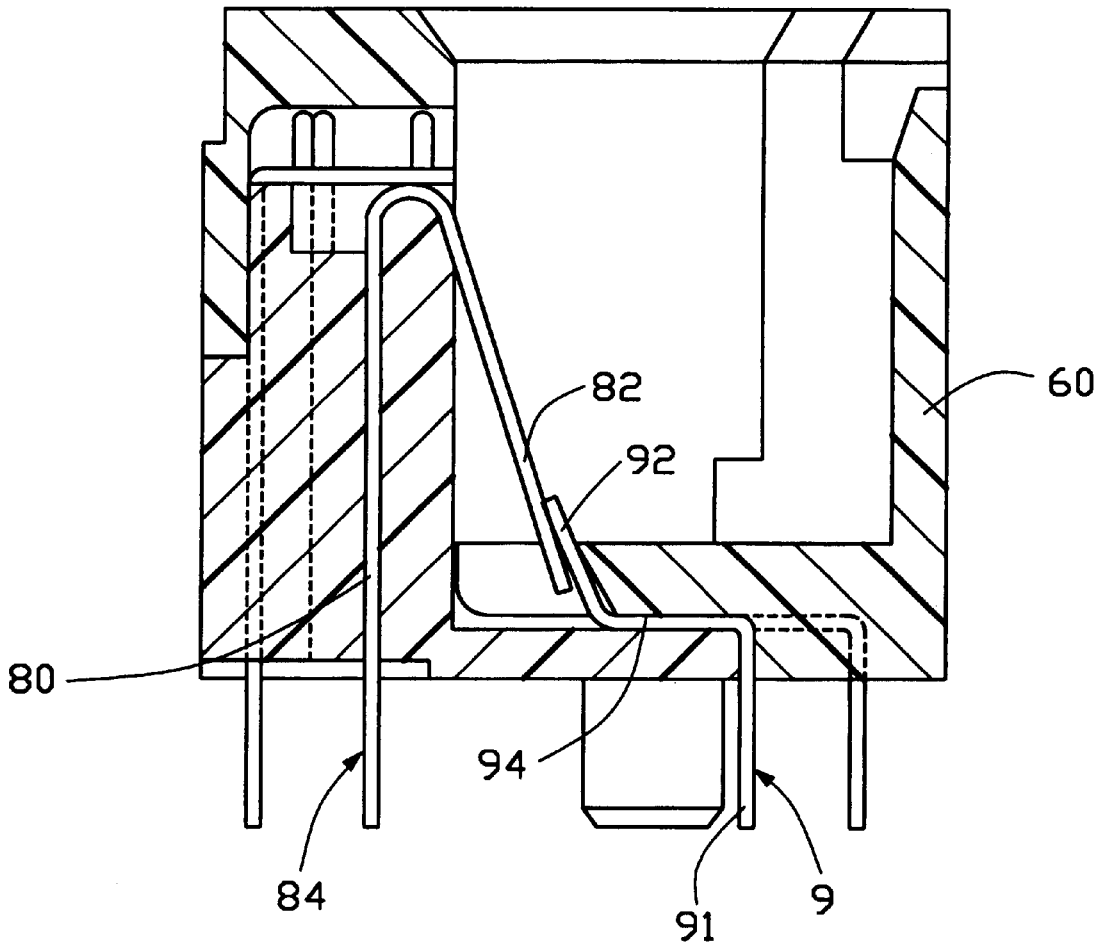
FIG. 7 is a cross-sectional view of a conventional electrical connector.

Referring to FIG. 5, at a first position, when no mating connector (not shown) is inserted in the receiving cavity 14, the free contact portion 22 of the terminal 20 pushes against the contacting portion 3342 of the switch member 30 in a first direction outward and upward. The switch member 30 bears a single directional force outward and upward. Referring to FIG. 6, at a second position, where a mating connector has been fully inserted into the receiving cavity 14, the contact portion 22 of the terminal 20 is pushed down and away from the contacting portion 3342 of the switch member 30. At the same time, the main body 42 of the door 40 is pushed rearwardly to move the resilient arm 334 in a second direction, downward and inward, opposite to the first direction, and the protrusion 422 abuts against the bump 110 of the top wall 11. Thus, each resilient arm 334 bears two opposite biasing forces in two opposite directions at the two different positions where the electrical connector either mates with or is absent from the mating connector. Since each resilient arm is placed under opposite biasing forces in its two normal operating position, its resilient characteristics are maintained over a longer period, materially improving the performance of the switch structure in this electrical connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a top wall, a mating opening, a rear wall, and a receiving cavity;

a plurality of terminals secured in the insulative housing, each terminal having a free contact portion extending into the receiving cavity and moveable by a mating connector;

a switch member comprising a securing portion secured to the rear wall of the insulative housing, and a depending portion extending from the securing portion for being urged toward a first direction by the contact portion of the terminal; and a door pivotally mounted to the top wall of the housing, the door comprising a main body abutting against the depending portion of the switch member, the main body being operable rearward by insertion of the mating connector to move the depending portion toward a second direction opposite to the first direction;

wherein the depending portion of the switch member comprises a support portion proximate to the rear wall of the housing and a resilient arm extending from the support portion for connecting with the contact portion of the terminal;

wherein the securing portion of the switch member comprises an interfering portion for securing the switch member to the rear wall of the housing and a solder leg extending out of the housing for soldering to the printed circuit board;

wherein a slot is defined through the rear wall of the housing near the top wall, a mounting opening is defined through the rear wall and in communication with the slot, and the door comprises a pivot portion received in the slot;

wherein the top wall comprises a bump, and the door comprises a protrusion projecting from a front side of the main body for abutting against the bump of the top wall to regulate a forward pivotal movement of the main body of the door;

wherein a groove is defined in a rear side of the main body and the depending portion of the switch member correspondingly forms a positioning portion for engaging with the groove;

wherein a plurality of slots are defined in a rear side of the main body of the door, and a corresponding number of switch members are provided, each resilient arm of one switch member entering into a corresponding slot.

* * * * *